US010012222B2

(12) United States Patent
Lilie et al.

(10) Patent No.: US 10,012,222 B2
(45) Date of Patent: Jul. 3, 2018

(54) SUCTION MUFFLER LOCATED INSIDE A PISTON OF A LINEAR COMPRESSOR

(71) Applicant: Whirlpool S.A., São Paulo-Sp (BR)

(72) Inventors: Dietmar Erich Bernhard Lilie, Joinville-Sc (BR); Talita Wajczyk, Joinville-Sc (BR)

(73) Assignee: Whirlpool S.A., Sao-Paulo-SP (BR)

( * ) Notice: Subject to any disclaimer, the term of this patent is extended or adjusted under 35 U.S.C. 154(b) by 349 days.

(21) Appl. No.: 14/652,607

(22) PCT Filed: Dec. 16, 2013

(86) PCT No.: PCT/BR2013/000575
§ 371 (c)(1),
(2) Date: Jun. 16, 2015

(87) PCT Pub. No.: WO2014/094094
PCT Pub. Date: Jun. 26, 2014

(65) Prior Publication Data

US 2015/0330378 A1 Nov. 19, 2015

(30) Foreign Application Priority Data

Dec. 18, 2012 (BR) ..... 1020120323435

(51) Int. Cl.
*F04B 35/04* (2006.01)
*F04B 39/00* (2006.01)
*F04B 17/04* (2006.01)

(52) U.S. Cl.
CPC ..... *F04B 35/045* (2013.01); *F04B 17/04* (2013.01); *F04B 39/0022* (2013.01);
(Continued)

(58) Field of Classification Search
CPC ..... F04B 39/0061; F04B 39/0027; F04B 39/0022; F04B 17/04; F04B 17/046; F04B 39/0055; F04B 53/001; F04B 11/0091
See application file for complete search history.

(56) References Cited

U.S. PATENT DOCUMENTS 3,592,565 A * 7/1971 Kofink ..... F04B 17/046 417/417
2010/0260629 A1* 10/2010 Kang ..... F04B 35/045 417/417

FOREIGN PATENT DOCUMENTS

BR PI1000181 A2 8/2011
BR PI1004881 A2 12/2013
(Continued)

OTHER PUBLICATIONS

International Search Report dated May 9, 2014. International Application PCT/BR2013/000575, Filed Dec. 16, 2013.

*Primary Examiner* — Bryan Lettman
*Assistant Examiner* — Timothy Solak
(74) *Attorney, Agent, or Firm* — Harrington & Smith

(57) ABSTRACT

The compressor comprises a movable assembly carrying a suction muffler and formed by: a piston (10) having a skirt (11) with an open rear end (11*a*) and a closed front end (11*b*) which carries a suction valve (50); and an actuator. The suction muffler comprises: a first and a second tubular insert (61, 62) defining a first and a second chamber (C1, C2) and having confronting open ends (61*a*, 62*a*) spaced from each other, and closed opposite ends (61*b*, 62*b*) respectively affixed to a top wall (12) of the piston (10) and to the actuator; a third tubular insert (63) internally lining the skirt (11); and an annular passage (15), between the third and the second tubular inserts (63, 62), open to the first and second
(Continued)

chambers (C1, C2), and communicating the open rear end (11*a*) of the skirt (11) with the suction valve (50).

13 Claims, 2 Drawing Sheets

(52) U.S. Cl.
CPC ..... *F04B 39/0055* (2013.01); *F04B 39/0061* (2013.01); *F04B 39/0005* (2013.01); *F04B 39/0027* (2013.01)

(56) References Cited

FOREIGN PATENT DOCUMENTS

| | | | | | |
|---|---|---|---|---|---|
| WO | 2004106737 | A1 | | 9/2004 | |
| WO | 2008082116 | A2 | | 7/2008 | |
| WO | 2009/054631 | | * | 4/2009 | ..... F04B 17/04 |
| WO | 2012068658 | A2 | | 5/2012 | |

* cited by examiner

SUCTION MUFFLER LOCATED INSIDE A PISTON OF A LINEAR COMPRESSOR

CROSS REFERENCE TO RELATED APPLICATIONS

This application is the U.S. national phase of PCT/BR2013/000575 filed Dec. 16, 2013, which claims priority of Brazil Patent Application BR1020120323435 filed Dec. 18, 2012, which is incorporated herein by reference.

FIELD OF THE INVENTION

The present invention refers to suction muffler for a refrigeration compressor driven by a linear motor and, more specifically, to a suction muffler to be assembled in the interior of the compressor piston. The invention further refers to the provision of a linear motor compressor of the type comprising a movable assembly formed by: a piston having a cylindrical tubular skirt, with an open rear end and a front end closed by a top wall carrying a suction valve; and an actuating means, connected to the piston to drive the latter in a reciprocating motion, said compressor being provided with said suction muffler mounted to the piston and to the actuating means.

BACKGROUND OF THE INVENTION

The compressor of the type considered herein, used in refrigeration systems and driven by a linear electric motor, comprises a housing, usually hermetic and lodging a non-resonant assembly, including a crankcase. In this type of known construction, the crankcase incorporates a cylinder inside which is defined a compression chamber, having an end usually closed by a valve plate and by a head, and an um open opposite end through which is assembled a piston, reciprocating inside the cylinder and defining, therewith and with the valve plate, the compression chamber.

The piston used in the subject compressor presents a cylindrical tubular body, with an open rear end and a front end closed by a top wall which carries a suction valve. The cylindrical tubular body defines a tubular skirt portion of the piston, which is closed, next to an end edge, by the top wall (defining a head portion in the piston). For these constructions, the top wall of the piston presents suction openings selectively closed by the suction valve, as described and illustrated in the Brazilian patent document PI 1000181-6.

The piston is coupled, usually by means of a rod, to an actuating means, which carries magnets driven by the supply of energy to the linear motor mounted to the crankcase.

The rod is provided inside the piston and presents a first end, affixed to the piston, in the top wall region thereof, and a second end affixed to the actuating means.

The linear motor drives the actuating means in a reciprocating motion, being responsible for generating the required thrust for displacing the piston inside the cylinder and for the compression of the refrigerant fluid in the form of gas. The piston, the rod and the actuating means form a movable assembly of the compressor, to which movable assembly is coupled a resonant spring mounted in order to apply opposing axial forces on the piston, upon the reciprocating axial displacement of the latter inside the cylinder. The resonant spring acts as an axial displacement guide for the piston, further acting on the movable assembly of compression, together with the linear motor of the compressor. The movable assembly of compression and the resonant spring define the resonant assembly of the compressor.

In some constructions of linear compressor having the suction being made through the piston, it may be necessary the assembly, in the interior thereof, of a noise muffler (suction muffler), in order to inhibit the transmission, through the gas, of different frequencies generated by the gas flow through the suction valve and by the motion the latter (WO2004/106737, PI1004881).

In the solution PI1004881, the suction muffler is mounted radially spaced inwards from the tubular skirt portion of the piston, defining, in this spacing, a volume for a chamber acting on the noise attenuation, having been designated as chamber C3 on said prior patent application.

Although said suction muffler construction internal to the piston provides efficient noise attenuation, it presents the drawback of allowing the heating of the gas being admitted in the interior of the piston. The chamber continuously holds a volume of gas therein, which receives the heat conducted from the top wall of the piston to its tubular skirt portion, hence to the gas contained inside said chamber and from the latter to the gas being drawn through the piston. The gas heated in said chamber is progressively mixed with the gas entering in the piston, in a common region of the latter adjacent to the gas inlet, heating the gas being sucked to the compression chamber. This undesirable heating of the gas being drawn through the piston tends to cause an efficiency loss which is more relevant than the acoustic gain obtained with the chamber of this prior solution.

OBJECTIVES OF THE INVENTION

It is thus an objective of the present invention to provide a suction muffler, to be mounted inside the piston of a linear motor compressor and which is designed to prevent the refrigerant gas being sucked inside the piston from directly contacting the tubular skirt portion of the latter, and to reduce risks of breaking or other damages which may compromise the proper operation of the compressor, ensuring operational reliability throughout the lifespan thereof.

Another objective of the present invention is to provide a suction muffler, such as described above and which allows an efficient attenuation of a range of frequencies.

An additional objective of the present invention is to provide a muffler, such as mentioned above and which allows different settings in the tuning mass in the compressor, in order to reduce the natural frequency generated by the operation of the compressor mechanism, making usually unnecessary the provision of an extra mass in the movable assembly.

A further additional objective of the present invention comprises the provision of a compressor including said suction muffler.

SUMMARY OF THE INVENTION

One of the objectives of the invention is achieved by the provision of a suction muffler to be applied in a linear motor compressor of the type comprising a movable assembly formed by: a piston having a cylindrical tubular skirt, with an open rear end and a front end closed by a top wall which carries a suction valve; and by an actuating means, connected to the piston to drive it in a reciprocating motion.

According to the present invention, the muffler comprises: a first and a second tubular insert, with at least the second of which being totally located inside the skirt, said first and second tubular inserts having confronting and spaced apart open ends, and closed opposite ends, respectively affixed to the top wall of the piston and to the actuating means, the first and the second tubular inserts defining, in the interior thereof, a first and a second chamber, respectively; a third tubular insert, in a material of low thermal conductivity and disposed so as to internally cover the piston skirt; and an annular passage, defined by a radial spacing between the third tubular insert and the second tubular insert and which is open to the first and second chamber, through the open ends of the first and of the second tubular inserts, and communicating the open rear end of the skirt with the suction valve. According to a particular form of the present invention, the first insert has a portion of its extension, adjacent to the open end, projecting to the interior of the skirt and defines a radial spacing in relation to the third tubular insert, in order to form another annular passage facing the annular passage and open to the latter and to the interior of the first and of the second chamber.

With this arrangement, the flow of gas being drawn through the interior of the piston does not come into direct contact with the piston skirt as it flows through the annular passage between the second and the third insert and further through the other annular passage, if provided, defined between the first and the third inserts.

The invention further provides a linear motor compressor of the type considered above and whose piston carries, in its interior, a suction muffler having the constructive and operational features mentioned above.

According to the present invention, the suction acoustic muffler provided inside the piston is generally of the tube-volume-tube type, acting on the attenuation of frequencies higher than a certain cutoff frequency. In acoustic terms, the attenuation obtained above the cutoff frequency is defined by the areas and lengths of the annular passages (tubes). The total passage area is calculated in order to reduce the load losses upon the passage of the refrigerant gas through the interior of the piston, preventing modifications in the direction of the flow and any direct contact between the refrigerant gas and the piston skirt. Furthermore, the acoustic muffler, in the piston construction of the present invention, also acts as a tuning mass, avoiding the need for providing additional masses in the compressor.

BRIEF DESCRIPTION OF THE DRAWINGS

The invention will be described below, with reference to the enclosed drawings, given by way of example of a possible embodiment of the invention, and in which.

DESCRIPTION OF THE INVENTION

The present invention refers to a refrigeration compressor with a linear motor and which comprises, inside a usually hermetic housing, the same basic components described in the introduction of the present specification. As already described, the compressor comprises a crankcase incorporating a cylinder, having an end generally closed by a valve plate and an open opposite end and through which is mounted a piston 10. The piston 10 is coupled, by means of a rod 20, to an actuating means 30, carrying the known magnets 31 (only one being illustrated in FIG. 1) energized by a non-illustrated linear motor, to provide the reciprocating motion to the actuating means 30.

The piston 10, the rod 20 and the actuating means 30 form a movable assembly of the compressor, to which movable assembly is coupled a resonant spring (not illustrated), mounted so as to apply opposite axial forces on the piston 10, upon its reciprocating axial displacement. The compression movable assembly (with the non-illustrated resonant spring) defines the resonant assembly of the compressor.

Figure 1:
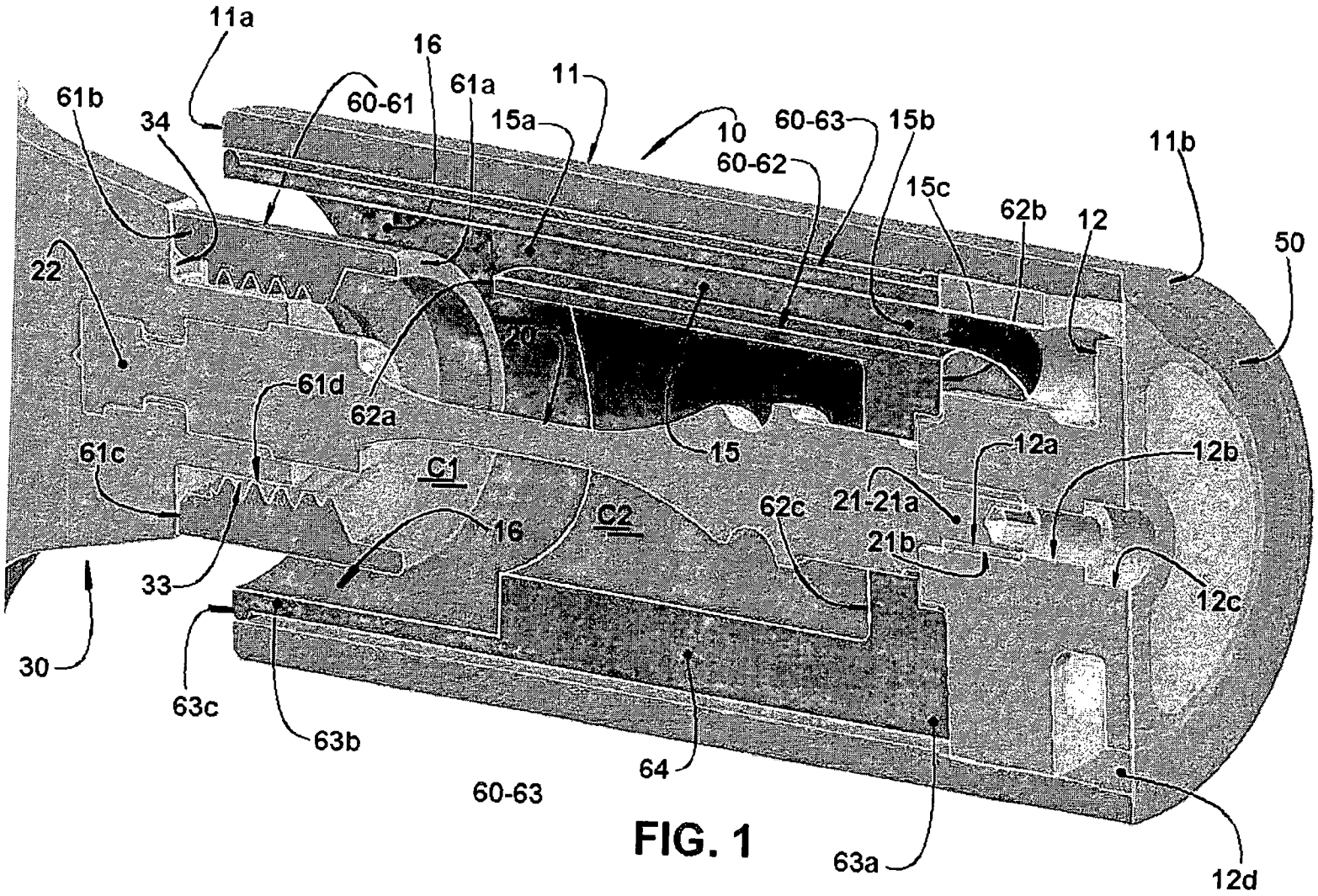
FIG. 1 represents an schematic, partially cut perspective view of the movable assembly of a linear compressor, having the piston thereof internally provided with a suction muffler built according to the present invention.

The piston 10 presents a cylindrical tubular skirt 11, with an open rear end 11*a* and a front end 11*b* closed by a top wall 12 carrying a suction valve 50 (see FIG. 1). In the illustrated embodiment, the piston 10 is formed in multiple parts, as better described further below.

In the illustrated embodiment, the skirt 11 and the top wall 12 of the piston 10 are formed in separate pieces, which may be fixed to each other by a suitable fixation means, such as glue, weld, or by mechanical interference, or also by a screw P1 (see FIGS. 1 *e* 2).

The skirt 11 is, for example, defined by a respective steel tube extension, preferably with an outer surface hardening treatment and presents an end edge region, including the front end 11*b* thereof, configured to fix the top wall 12.

Due to the fact that the skirt 11 and the top wall 12, as parts of the piston 10, define two distinct parts, each of said parts may be obtained from a specific process and of a more suitable material to the function to be carried out by each of these parts. It should be further understood that the present solution also foresees the possibility of using the same process for obtaining said parts which form the piston in the present invention, and also the same material for obtaining both parts for the formation of the piston 10, which characteristics should not be understood as limiting the present solution.

The rod 20 extends along the interior of the piston 10 and presents a first end 21, fixed to the piston 10, in the region of the top wall 12 thereof, and a second end 22, fixed to the actuating means 30.

According to the constructive form being described and illustrated in the attached drawings, the first end 21 of the rod 20 is preferably configured in the form of an axial projection 21*a*, of reduced diameter, provided with an outer thread 21*b* and engaged inside a threaded axial hole 12*a* of the top wall 12 of the piston 10. This exemplary construction promotes a solid and tight fixation of the first end 21 of the rod 20 to the top wall 12 of the piston 10. The threaded axial hole 12*a* presents an axial extension 12*b* which extends until reaching the front face of the top wall 12, by means of a widening 12*c*.

In the construction illustrated herein, the suction of the refrigerant fluid takes place through the piston 10. For this construction, the top wall 12 of the piston 10 presents suction openings 12*d* selectively closed by the suction valve 50 which is mounted in an outer face of said top wall 12.

Inside the piston 10 is housed a suction muffler 60 (or noise muffler) comprising: a first and a second tubular insert 61, 62, generally cylindrical and located longitudinally around the rod 20, with at least the second of which being entirely located in the interior of the skirt 11, said first and second tubular insert 61, 62 having open ends 61*a*, 62*a*, facing each other and spaced apart, and closed opposite ends 61*b*, 62*b*, respectively affixed to the actuating means 30 and to the top wall 12 of the piston 10.

As illustrated, the first and the second tubular insert 61, 62 have their closed opposite ends 61*b*, 62*b*, respectively affixed to the top wall 12 of the piston 10, by means of the first end 21 of the rod 20, and to one of the parts of second end 22 of the rod 20 and actuating means 30.

According to the invention, the first and second tubular insert 61, 62 define, in the interior thereof, a first chamber C1 and a second chamber C2, respectively. It is further provided a third tubular insert 63, in a low thermal conductivity material and disposed so as to internally cover the skirt 11 of the piston 10, defining a radial spacing with the second tubular insert 62, for forming an annular passage 15 open to the first and second chamber C1, C2, through the open ends 61*a*, 62*a* of the first and second tubular insert 61, 62, and communicating the open rear end 11*a* of the skirt 11 with the suction valve 50.

In the illustrated embodiment, the first and second tubular inserts 61, 62 are coaxial and present the same outer diameter. This configuration prevents the flow of refrigerant gas being admitted inside the skirt 11 of the piston 10 from suffering any modification in its straight trajectory towards the top wall 12 of the piston 10 and to the suction valve 50. However, the invention may still be carried out with said tubular inserts 61, 62 presenting different diameters. Furthermore, said tubular inserts 61, 62 may be eccentric (not coaxial to each other), in the hypothesis said eccentricity is acoustically beneficial and does not impair the operation of the suction valve 50.

Still according to the illustrated embodiment the first insert 61 has a portion of its extension, adjacent to the open end 61*a*, projecting to the interior of the skirt 11 of the piston 10 and defining a radial spacing in relation to the third tubular insert 63, in order to form another annular passage 16, facing the annular passage 15 and open to the latter and to the interior of the first and second chambers C1, C2.

As illustrated, the annular passage 15 and the other annular passage 16 are preferably defined by the same constant radial spacing of the first and second inserts 61, 62 in relation to the third insert 63. This arrangement, added to the fact that the first and the second inserts are preferably coaxial and generally, but not mandatorily, having the same outer diameter, allows maintaining the same annular cross section for the straight passage of the flow of refrigerant gas through the interior of the piston 10, in the direction of the suction valve 50, reducing load losses in the gas flow when sucked to the compression chamber of the compressor. However, it should be understood that the technical solution proposed may also be carried out, in a thermally advantageous manner, independently of the geometric characteristics presented by the two annular passages 15 and 16 along their longitudinal extension. According to the illustrated embodiment, the annular passage 15 has a first end 15*a* open to the interior of the first and second muffler chambers C1, C2 and also to the other annular passage 16, if the latter is provided, and a second end 15*b* provided with an annular window 15*c* open to the suction openings 12*d* of the top wall 12 of the piston and, consequently, to the suction valve 50.

Still according to the illustrated embodiment, the closed opposite end 62*b* of the second tubular insert 62 incorporates an inner annular wall 62*c* configured to be seated and axially locked in a tight manner, by any suitable means, for example threads, around the region of the first end 21 of the rod 20. Furthermore, said inner annular wall 62*c* may be provided with a median recess 62*d* facing outwards and defined around the central opening of said inner annular wall 62*c* and seated on a confronting cutout region of the top wall 12.

The third tubular insert 63 may be built in a separate piece in relation to the first and second tubular insert 61, 62, and be fitted and retained, for example, by mechanical interference, inside the skirt 11 of the piston 10. Additionally, the third insert 63 may present at least one small outer annular projection 63*c*, provided in the region of said opposite end 63*b*, to be radially seated against the skirt 11 in the region of the open rear end 11*a* thereof, in order to maintain the third tubular insert 63 slightly spaced from the skirt 11, however preventing the entrance of refrigerant gas inside the small radial spacing defined between the skirt 11 and the third tubular insert 63. The third tubular insert 63 may further incorporate other outer annular projections axially spaced from the outer annular projection 63*c* provided in the region of the opposite end 63*b*. The third tubular insert 63 may have the end 63*a* thereof fitted in an annular recess (not illustrated), provided in the opposite face of the top wall 12 of the piston 10.

Figure 2:
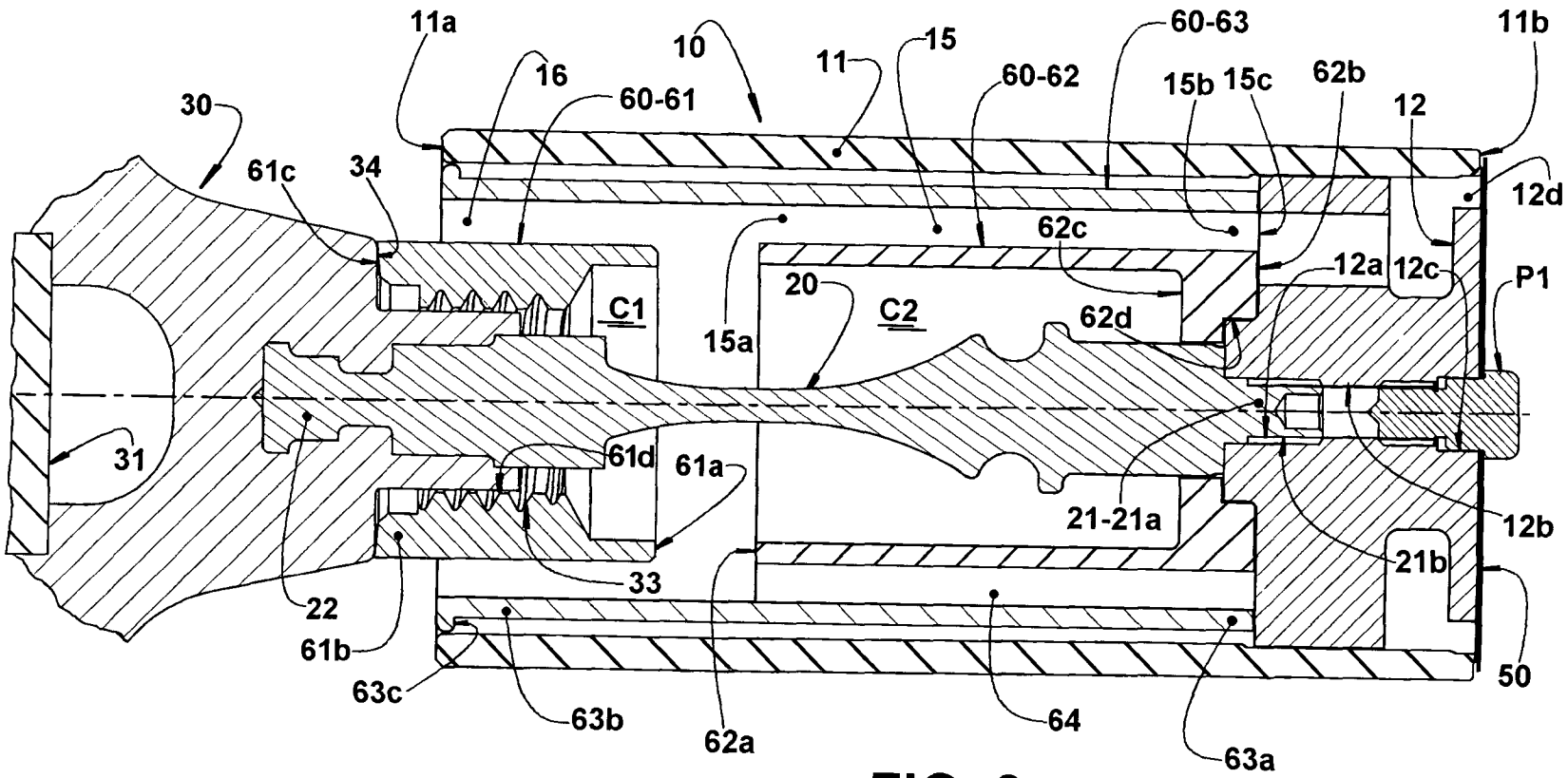
FIG. 2 represents a longitudinal cross-sectional view of the movable assembly illustrated in FIG. 1.

However, it should be understood that the third tubular insert 63 may be formed in a single piece with the second tubular insert 62, being joined to the latter by a plurality of radial fins 64, provided angularly offset from each other, for example by 120°, with only one of which being illustrated in FIGS. 1 and 2.

According to the present invention, the first insert 61 has the closed opposite end 61*b* thereof hermetically seated against and fixed to the actuating means 30. In this construction, the closed opposite end 61*b* of the first insert 61 presents an annular end edge 61*c*, to be hermetically seated against an annular wall 34 provided in the actuating means 30, and an inner thread portion 61*d*, to be engaged to a respective thread portion 33 provided in the actuating means 30. The annular end edge 61*c* may be seated against the annular wall 34 of the actuating means 30, by means of a suitable sealing means, ensuring the desired tightness.

The first tubular insert 61 is affixed by means of a thread which is already injected over the actuating means 30, which is generally provided in aluminum. It should be further considered the possibility of the first tubular insert 61 being formed in a single piece with the actuating means 30.

The illustrated assembly has the advantage of not requiring too tight tolerances for injected parts, and the telescopic assembly has the advantage of providing some type of adjustment or tuning during the assembly process.

It should also be observed that the tubular inserts may vary in the constructive and assembly forms, according to the desired acoustic function, setting of tuning mass, ease of production thereof and assembly inside the piston. Such modifications do not affect the more general concept disclosed herein of a muffler provided in multiple parts and assembled in the interior of the piston, in order not to affect the functionality of the elements defining the movable assembly of the compressor and to prevent the refrigerant gas being admitted inside the piston 10 from coming into direct contact with the skirt 11 thereof.

Although configurations having been illustrated herein in which the actuating means 30 is connected to the piston 10 by a rod 20, internal to the piston 10, it should be understood that the actuating means 30 may be directly connected to the open rear end 11*a* of the skirt 11 of the piston 10, in which situation the rod 20, if provided, is no longer located inside the piston 10.

In said non-illustrated construction, the suction muffler 60 also comprises the same three tubular inserts 61, 62, 63 illustrated in FIGS. 1 and 2, likewise located in the interior of the piston 10 and having the open ends 61*a*, 62*a*, facing each other and spaced from each other, of the first and second tubular inserts 61, 62, and their closed opposite ends 61*b*, 62*b*, respectively affixed to the top wall 12 of the piston 10 and to the actuating means 30, by means of constructions very similar, if not identical, to those previously described with reference to the attached drawings.

Independently of the existence of the rod 20 inside the piston 10, the present noise muffler is of the tube-volume-tube type, in which the first tube is defined by the annular passage 15, and the second tube is defined by the other annular passage 16. The volume is defined by the first and second chambers C1, C2.

Due to the fact that the linear compressor is a resonant system, in certain moments it requires the addition of an extra mass in the movable assembly, in order to reduce the variability of the natural resonant frequency of the system. With the present construction of piston 10, it is possible to carry out this mass addition by replacing the material of at least one of the tubular inserts 61, 62, 63 by a material having the desired density for the tuning to be achieved. In a constructive form of carrying out said tuning, the first and/or the second tubular insert 61, 62, may be obtained from a material having a greater density than plastic, as steel for example. In the situation in which there is no need for adjusting the tuning mass, the third tubular insert 63, as well as the first and the second tubular inserts 61, 62, are built in a thermally insulating material, for example a low density plastic material, thereby not modifying the characteristics already set in the compressor.

The invention claimed is:

1. A suction muffler for a linear motor compressor of the type comprising a movable assembly formed by: a piston having a cylindrical tubular skirt, with an open rear end and a front end closed by a top wall carrying a suction valve; and an actuator, connected to the piston to drive it in a reciprocating motion, said muffler being characterized in that it comprises: a first and a second tubular insert, at least the second of which being entirely located in the interior of the skirt, said first and second tubular inserts having confronting open ends spaced from each other, and closed opposite ends respectively affixed to the top wall of the piston and to the actuator, the first and the second tubular inserts defining, in the interior thereof, a first chamber and a second chamber, respectively; a third tubular insert, made of a thermally insulating material and provided so as to internally line the skirt of the piston; and an annular passage, defined by a radial spacing between the third tubular insert and the second tubular insert and which is open to the first and second chambers, through the open ends of the first and the second tubular inserts, and communicating the open rear end of the skirt with the suction valve.

2. The suction muffler, as set forth in claim 1, characterized in that the first and second tubular inserts are coaxial.

3. The suction muffler, as set forth in claim 1, characterized in that the first and second tubular inserts have the same outer diameter.

4. The suction muffler, as set forth in claim 1, characterized in that the first insert has a portion adjacent to the open end which projects to the interior of the skirt and defines a radial spacing in relation to the third tubular insert, in order to form another annular passage facing the annular passage and open to the latter and to the interior of the first and second chambers.

5. The suction muffler, as set forth in claim 4, characterized in that the annular passage and the other annular passage are defined by the same constant radial spacing of the first and second inserts in relation to the third insert.

6. The suction muffler, as set forth in claim 4, characterized in that the third tubular insert is built in a single piece with the second tubular insert, being joined to the latter by a plurality of radial fins, arranged angularly offset in relation to each other.

7. The suction muffler, as set forth in claim 4, characterized in that the third tubular insert presents an opposite end and at least one small outer annular projection, provided in a region of said opposite end and radially seated against the skirt in a region of the open rear end of the skirt, to maintain the third tubular insert slightly spaced from the skirt and preventing the refrigerant gas from entering into the interior of a reduced radial spacing defined between the skirt and the third tubular insert.

8. The suction muffler, as set forth in claim 7, characterized in that the first insert has its closed opposite end hermetically seated and affixed in the actuator.

9. The suction muffler, as set forth in claim 8, characterized in that the closed opposite end of the first tubular insert presents an annular end edge, to be hermetically seated against an annular wall provided in the actuator, and an inner thread portion to be engaged to a respective thread portion provided on the actuator.

10. The suction muffler, as set forth in claim 1, the compressor being provided with a rod internal to the piston and having a first end affixed to the piston in a region of the top wall, and a second end affixed to the actuator, the muffler being characterized in that the first and second tubular inserts are located around the rod and have the closed opposite ends thereof respectively affixed to the top wall of the piston by means of the first end of the rod, and to the actuator by the second end of the rod.

11. The suction muffler, as set forth in claim 10, characterized in that the first end of the rod is in the form of an axial projection of reduced diameter, provided with an outer thread and engaged inside a threaded axial hole of the top wall of the piston.

12. The suction muffler, as set forth in claim 10, characterized in that the closed opposite end of the second tubular insert incorporates an inner annular wall which is seated and axially locked, around the region of the first end of the rod.

13. The suction muffler, as set forth in claim 12, characterized in that the inner annular wall is provided with a median recess facing outwards and seated on a confronting cutout region of the top wall of the piston.

* * * * *